US006027339A

United States Patent [19]

Dreyer et al.

[11] Patent Number: 6,027,339

[45] Date of Patent: Feb. 22, 2000

[54] RING FURNACE WITH CENTRAL TUBULAR FLOW

[75] Inventors: Christian Dreyer, Saint-Jean de Maurienne; Jean-Christophe Rotger, Voiron, both of France

[73] Assignee: Aluminium Pechiney, Paris, France

[21] Appl. No.: 09/324,859

[22] Filed: Jun. 3, 1999

[30] Foreign Application Priority Data

Jun. 11, 1998 [FR] France ..... 98 07536

[51] Int. Cl.[7] ..... F27D 7/00

[52] U.S. Cl. ..... 432/192; 432/194; 432/249

[58] Field of Search ..... 432/19, 192, 194, 432/247, 249, 209

[56] References Cited

U.S. PATENT DOCUMENTS

| | | | |
|---|---|---|---|
| 1,351,305 | 8/1920 | Smith et al. . | |
| 3,975,149 | 8/1976 | Racunas et al. | 432/209 |
| 4,253,823 | 3/1981 | Holdner | 432/192 |
| 4,552,530 | 11/1985 | Gunnes et al. | 432/192 |
| 4,859,175 | 8/1989 | Dreyer et al. | 432/192 |
| 4,957,428 | 9/1990 | Valassopoulos et al. | 432/192 |

FOREIGN PATENT DOCUMENTS

| | | |
|---|---|---|
| 468252 | of 1928 | Germany . |
| 2129918 | 5/1984 | United Kingdom . |

*Primary Examiner*—Teresa Walberg
*Assistant Examiner*—Gregory A. Wilson
*Attorney, Agent, or Firm*—Dennison, Scheiner, Schultz & Wakeman

[57] ABSTRACT

The furnace for baking carbonaceous blocks comprises, along the longitudinal X direction of the furnace, a series of sections, each section comprising, in the transverse Y direction, hollow walls (3) through which a heating gas flow comprising combustion gas or a cooling air flow circulates, alternating with pits containing carbonaceous blocks to be baked, each of the said hollow walls (3) in a section being in communication with a wall in an upstream section and/or a wall in a downstream section, so as to form a conduit through which the said gas flow circulates, each of the said walls of a section comprising two vertical lateral partitions (38) in the X-Z plane, and elements in the transverse Y direction for deflecting the said gas flow passing through the said wall and maintaining a constant spacing between the said lateral partitions (38), and characterized in that each wall (3) comprises a means of maintaining, over at least one third of the length L of said wall, a gas flow of rate D uniformly distributed over the entire normal cross-section S, with a decree of uniformity of the distribution of said flow of rete D defined by the expression "2yD−0.5yD/yS", where "2yD−0.5yD" denotes the extent of the range of the flow D corresponding to a fraction y of the said normal cross-section S, and in which y is not more than 0.25.

9 Claims, 5 Drawing Sheets

RING FURNACE WITH CENTRAL TUBULAR FLOW

FIELD OF THE INVENTION

This invention relates to ring furnace sections used for baking carbonaceous blocks, and particularly to furnaces with open type sections.

STATE OF THE ART

Ring furnaces with open type sections are known in themselves and have been described particularly in patent applications FR 2 600 152 (corresponding to American patent U.S. Pat. No. 4,859,175) and WO 91/19147. In these furnaces, a gas flow composed of air and/or combustion gases circulates through a series of active sections along the longitudinal direction of the furnace, inside a series of hollow heating walls (flue walls) that communicate with one another between adjacent sections, each section being made up by alternately placing these heating walls, in the transverse direction, adjacent to pits in which stacks of carbonaceous blocks to be baked are placed. This gas flow is forced on the upstream of the active sections and is sucked up on the downstream side of these sections.

A hollow wall of a section is typically in the form of a rectangular parallelepiped 5 m long (in the longitudinal direction of the furnace), 5 m high and 0.5 m wide (in the transverse direction of the furnace), that is a 0.3 m wide gas stream and twice a partition thickness of 0.1 m, subdivided into four vertical "shafts" by three vertical baffles placed in the transverse direction, each shaft being delimited either by two baffles, or by one baffle and one of the walls of the section, in order to lengthen the average path taken by cooling air or combustion gases in the said wall and also to provide a constant spacing between the longitudinal partitions (side members) of the wall.

Apart from the baffles, tie bricks are also laid out in the transverse direction, particularly between the said baffles, in order to maintain a constant spacing between the longitudinal partitions of the wall.

STATEMENT OF THE PROBLEM

A continuous concern for a manufacturer of baked carbonaceous blocks is to reduce the production costs of these baked carbonaceous blocks, and investment and/or maintenance costs of the furnaces used for their manufacture, particularly by extending the life of furnace refractory components, while maintaining constant quality.

Another concern is to improve the quality of baked carbonaceous blocks, and particularly to make the quality more constant and performances more uniform for a given carbonaceous block, and for different blocks.

Consequently, the applicant had the idea of modeling the circulation of gaseous fluids in existing furnace walls, knowing the dimensions and locations of baffles and tie bricks.

Firstly, he was surprised to find that the distribution of gas flows in hollow walls made according to the state of the art was far from being uniform and homogenous, such that under steady state conditions most of the gas flow traveled along preferred paths, leaving a non-negligible part of the partitions of the wall without any contact with the said gas flow. However, these partitions separate the carbonaceous blocks in the pits from the said heating or cooling gas flows and provide heat exchange between the gas flows and carbonaceous blocks. It is then more easily understood that this thermal heterogeneity of the partitions will either be the cause of variable quality in the carbonaceous blocks, or will necessitate (which tales place in practice) an increase in the heating or cooling power such that even the blocks in the worst position for heat exchange will satisfy the specified quality requirements.

Furthermore, the modeling also brought to light the large pressure loss in the gas flow due to the presence of the baffles, which has two consequences; firstly it increases the energy necessary to make the gas flow circulate through the series of walls, and secondly it increases the corresponding overpressure or negative pressure in the said walls, which causes an increase in thermal leaks inwards or outwards (from the said wall to the outside or from the outside to the said wall) and therefore the consumed energy.

Furthermore, since large temperature variations are frequently applied to the walls causing deterioration even though they are made of refractory bricks, they must be periodically replaced. Therefore the applicant also looked for methods of making a more economic furnace, both in terms of operating costs and in maintenance and investment costs.

Finally, they attempted to design methods of solving these problems (heterogeneous gas flow distribution within the walls, etc.), not only to design new furnaces without the disadvantages of known furnaces, but also and especially so that existing old furnaces can be adapted and modified to produce more economic furnaces, in terms of operating costs and maintenance costs. Considering the validity of the modeling recognized by the applicant, and the difficulty and very high cost of carrying out any experiments with real furnaces, the applicant searched for a solution to the problem caused using the same modeling instruments that were used to isolate the cause of the problems to be solved.

DESCRIPTION OF THE INVENTION

According to the invention, the ring furnace with open type sections (open ring furnace) for baking carbonaceous blocks in a rotating fire comprises, along the longitudinal X direction of the furnace, a series of sections separated by headwalls provided with openings, each section comprising, along the transverse Y direction of the furnace, hollow walls through which a heating gas flow comprising combustion gas or a cooling air flow circulates, alternating with pits containing carbonaceous blocks to be baked, each of the said hollow walls in a section being in communication with a wall in an upstream section and/or a wall in a downstream section, so as to form a conduit through which the said gas flow circulates from the upstream side to the downstream side in the X longitudinal direction on all sections fired simultaneously in the said ring furnace, each of the said walls of a section comprising two vertical lateral partitions in the X-Z plane, and elements in the transverse Y direction for deflecting the said gas flow passing through the said wall and maintaining a constant spacing between the said lateral partitions, and is characterized in that each wall comprises a means of maintaining, over a length L' equal to at least one third of the length L of the said wall, and typically by an appropriate choice of the said elements causing the said deflection, a gas flow of rate D uniformly distributed over the entire normal cross-section S of the said wall in the Y-Z plane, with uniformity of the said flow distribution of the flow rate D defined by the expression "2yD−0.5yD/yS", where "2yD−0.5yD" denotes the extent of the range of the flow D corresponding to a fraction y of the said normal cross-section S, and in which y is a the most equal to 0.25.

The invention is distinguished from state-of-the-art furnaces in that the vertical baffles, usually three for each hollow wall, are eliminated.

According to the state of the art, if L denotes the length of the hollow wall in the X direction, H its height in the Z direction and as a first approximation if the height C of the baffles in the Z direction is assumed to be equal to the height M of the headwalls at the ends of the said wall, the average path of the gas flow may be broken down into a component along the longitudinal X direction over a length L, and a component in the vertical Z direction over a length 4×C, giving a total of L+4×C.

The values of C and M are typically between 0.6×H and 0.8×H. Thus with 3 baffles, the gas flow is a tubular flow that changes direction 8 times (X/Z–X/Z–X/Z–X/X), each baffle creating a direction change in the vertical direction Z and in the longitudinal direction X denoted "Z–X", by alternating longitudinal directions (X) and vertical directions (Z), the entire gas flow being concentrated at each passage through a baffle, over a normal cross-section S corresponding to a height of 0.2×H–0.4×H, in other words 20 to 40% of the entire cross-section S.

However according to the invention, and in the case in which the same type of hollow wall is used, the average gas flow goes along an average path which, as a first approximation and considering the lack of vertical baffles, is equal to the arithmetic mean of the shortest path (the length L) and the longest path (the length equal to L+2×M), in other words ½(L+L+2×M) or L+M, to be compared with the path according to the state of the art which is equal to L+4×C, where C is close to M.

Furthermore, due to an appropriate choice of the said elements controlling the said deflection, the gas flow, of rate D, is typically uniformly distributed over the entire normal cross-section S of the said wall n the Y-Z plane, with a degree of homogeneity of the said distribution of the flow rate D equal to 0.50D–0.125D/0.25S, the said degree of homogeneity being denoted "2yD–0.5yD/yS", where "2yD–0.5yD" is the extent of the fraction of the flow rate D corresponding to a fraction y (where y is not more than 0.25) of the said normal cross-section S which is equal o the product of the height "H" by the constant width "l" of the hollow walls.

Considering the fact that the deflection elements are oriented in the transverse direction Y and the resulting symmetry, the formula giving the degree of homogeneity is also valid in the X-Z plane, the cross-section S then being replaced by the height "H" where y is a traction of this height H.

Since the normal cross-section S is always taken in the Y-Z plane and the elements controlling the deflection being in the transverse Y direction, a digital simulation can be used to represent the distribution of the flow rate D in the X-Z plane of a hollow wall, as shown in FIGS. 3 and 4 representing sections or cross-sections through furnaces or hollow walls in the X-Z plane.

Gas flows are modeled by breaking down the total gas flow into a number N of elementary gas streams—for example about fifty streams as shown in FIGS. 3 and 4, and it displays the trajectories of each of these streams in the X-Z plane and therefore the distribution of elementary gas streams, in the same way as the spacing between contours on a map. Starting from this point, it is easy to calculate the real degree of homogeneity on each fraction "y" of the height H by counting the number "n" of elementary screams necessary to obtain the fraction n/N corresponding to the fraction "y" of the height which was set equal to 0.25.

This choice of 0.25 and the corresponding expression for the degree of homogeneity represents the degree of homogeneity found necessary according to the invention to obtain the advantages of the invention. Considering the law of mean, it is obvious that if the value of "y" increases, the degree of homogeneity is lower and is easier to achieve. Thus, the level expressed by "0.8D–0.2D/0.4S" corresponds to a lower degree of homogeneity than that expressed by "0.5D–0.125D/0.25S", to the extent that when the "y" fraction increases, the probability of a flow similar to yD also increases, by definition the entire flow D being present when y=1. Conversely, the degree of homogeneity would strongly increase for a degree of homogeneity such as "0.20D–0.05D/0.10S", in which "y" is low, this degree of homogeneity not necessarily being accessible over a large portion with length L', and not necessarily compulsory to obtain a significant improvement in the advantages according to the invention.

Therefore, the global degree of homogeneity is in fact expressed as the portion of the surface of the hollow wall in the X-Z plane (or the corresponding volume) in which the degree of homogeneity reaches at least a given threshold set equal to 0.5D–0.125D/0.25S.

According to the invention, at least the said degree of homogeneity is reached over at least one third of his area or (which is equivalent) one third of she length L of the said hollow wall.

The means according to the invention can solve the stated problem. Firstly, the invention gives a better distribution of the gas flow and therefore a better temperature homogeneity while reducing the pressure loss, which actually leads to a more homogenous production, a reduction in furnace operating costs and longer life of the furnaces.

DESCRIPTION OF THE FIGURES

FIG. 1 shows a diagrammatic sectional view along the X-Z plane, where X is the longitudinal direction and Z is the vertical direction, of the portion of the ring furnace 1 active simultaneously on 10 sections 2, each sect-on being separated from the next section by a headwall 32 provided with an opening 320 through which gas flows circulate with a flow rate D from the upstream side (at the right in the figure) where air is injected through a blowing ramp 231 fitted with one pipe 230 for each longitudinal hollow wall 3 fitted with baffles 31 (three baffles per hollow wall and per section), towards the downstream side (at the left in the figure) in which the gas flow is suck up by means of an exhaust ramp 211 fitted with one exhaust ramp 210 for each longitudinal hollow wall.

Burners 220 placed approximately in the middle of the series of the 10 sections, increase the temperature of the upstream gas flow to the required temperature, typically of the order of 1100° C. The sections on the upstream side of the burners are cooling sections for the carbonaceous blocks, while the sections on the downstream side of the burners are baking sections for the carbonaceous blocks.

Figure 1:
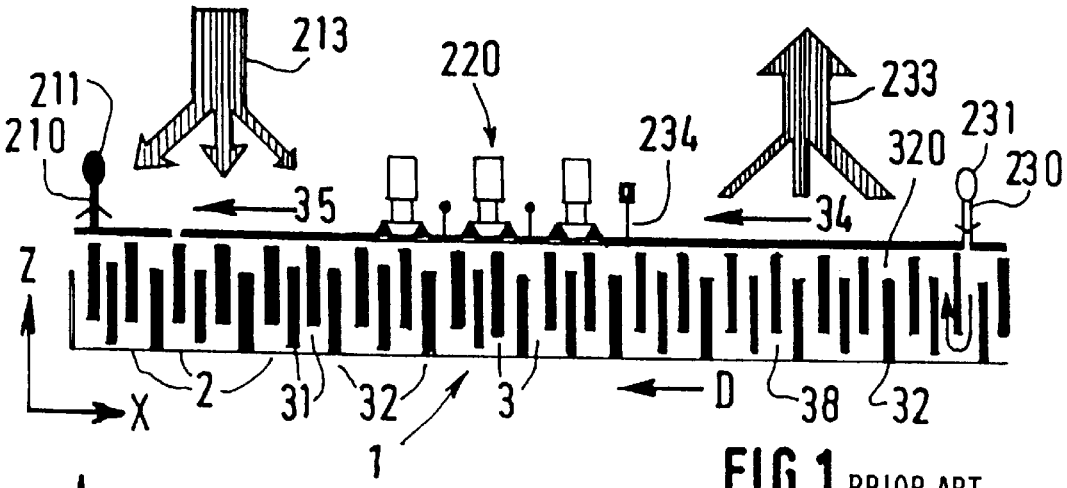
FIG.1 PRIOR ART
FIGS. 1, 1*a*, 2, 3 and 3*a* are applicable to furnaces according to the state of the art.
Figure 1A:
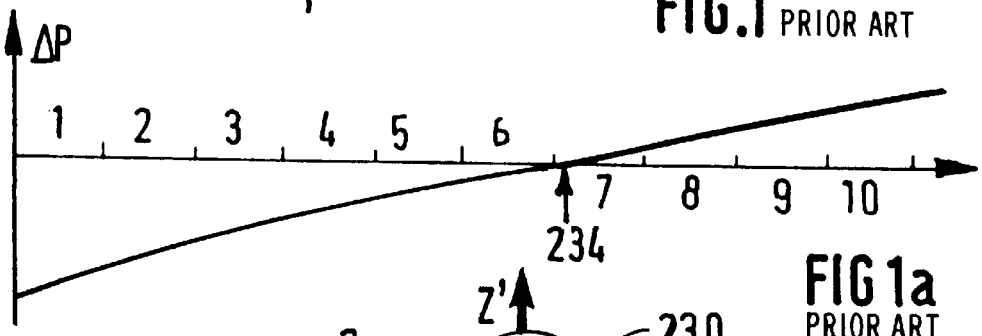
FIG 1a PRIOR ART

Considering the pressure in the furnace, as shown in FIG. 1*a*, a gas flow 233 can come out of the furnace on the upstream side of the burners, and a gas air flow 213 can penetrate into the furnace on the downstream side of the burners. Thus, the gas flow of rate D circulating in the said hollow walls is not a flow of constant rate due to these gas flows 213, 233 and also to the formation of volatile products that can burn while the carbonaceous blocks are being baked in the sections in the downstream part of the furnace. The gas flow is an air flow 34 in the upstream side of the burners 220, and is a combustion gas flow 35 mixed with an incident air flow 213 in the downstream part of the furnace, the rate of these flows being generically denoted by "D".

FIG. 1*a* shows the pressure curve for the said gas flow of rate D inside the said hollow walls 3. The pressure decreases uniformly from the upstream side towards the downstream side; it is greater than atmospheric pressure and maximum where air is blown into the ramp 230, it is close to atmospheric pressure immediately on the upstream side of the burners 220 where a pressure sensor 234 is installed, and is less than atmospheric pressure and minimum where the combustion gases are induced into the exhaust ramp 210.

Figure 2:
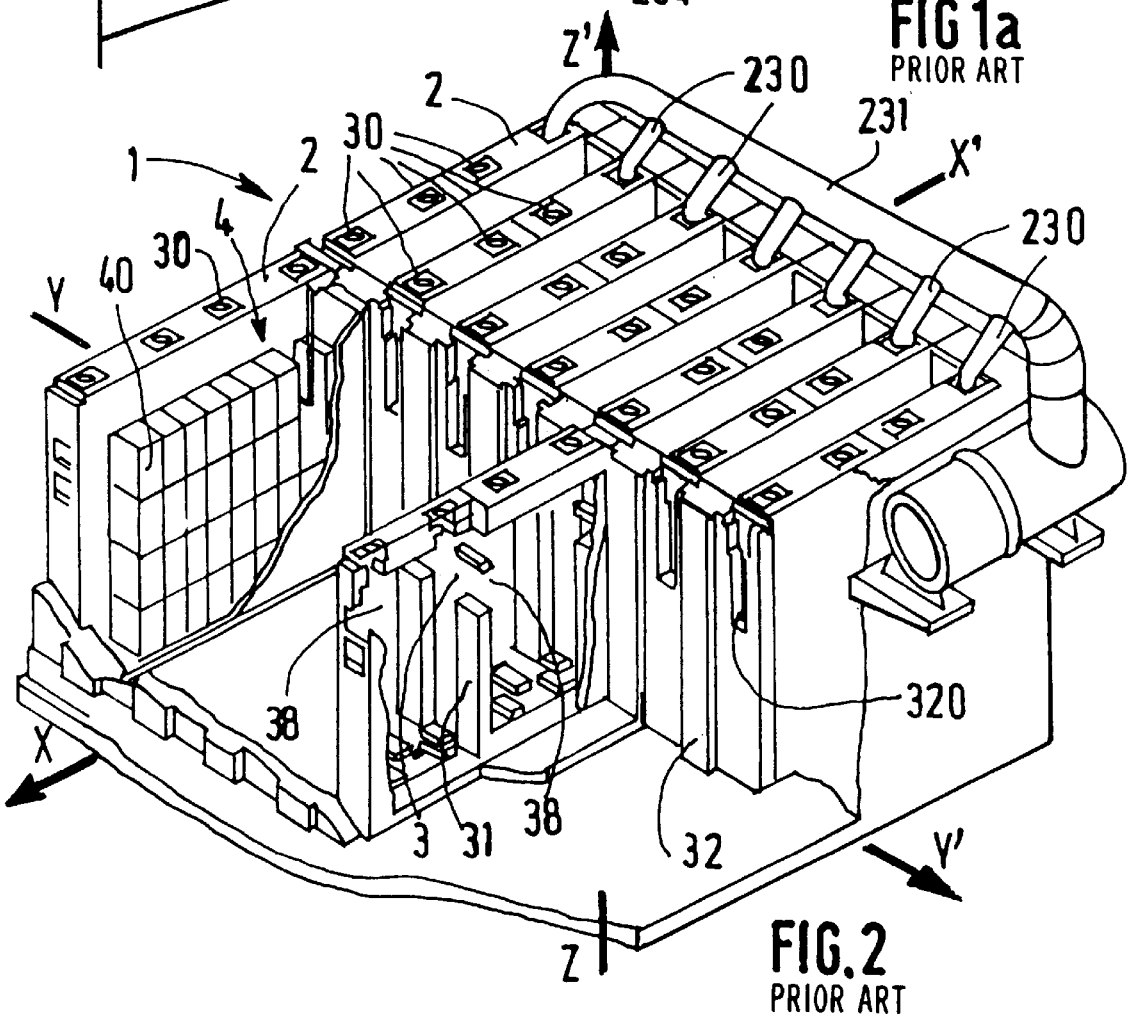
FIG.2 PRIOR ART

FIG. 2 shows a partially exploded perspective view of the upstream part of the series of active sections that shows, in the transverse direction Y for a given section 2, the alternation of hollow heating walls 3 and pits 4 containing stacks of carbonaceous blocks 40. Each hollow wall 3 is limited in the X-Z plane by —we vertical partitions 38 and contains three baffles 31, is provided with peepholes 30 through which a blowing ramp 230 can be inserted as shown in the figure, or exhaust ramp 210, burner injectors 220 or various measurement means. There are shafts 38 adjacent to the peepholes 30, in other words the space inside the said wall without any obstacles in which the above mentioned devices can be placed (for example a blowing ramp). The successive sections 2, two of which are shown in the figure, are separated by a wall 32 in which openings 320 are provided at the said hollow walls 3 through which the gas flow can pass from the upstream :o the downstream sides in the X'-X direction.

Figure 3:
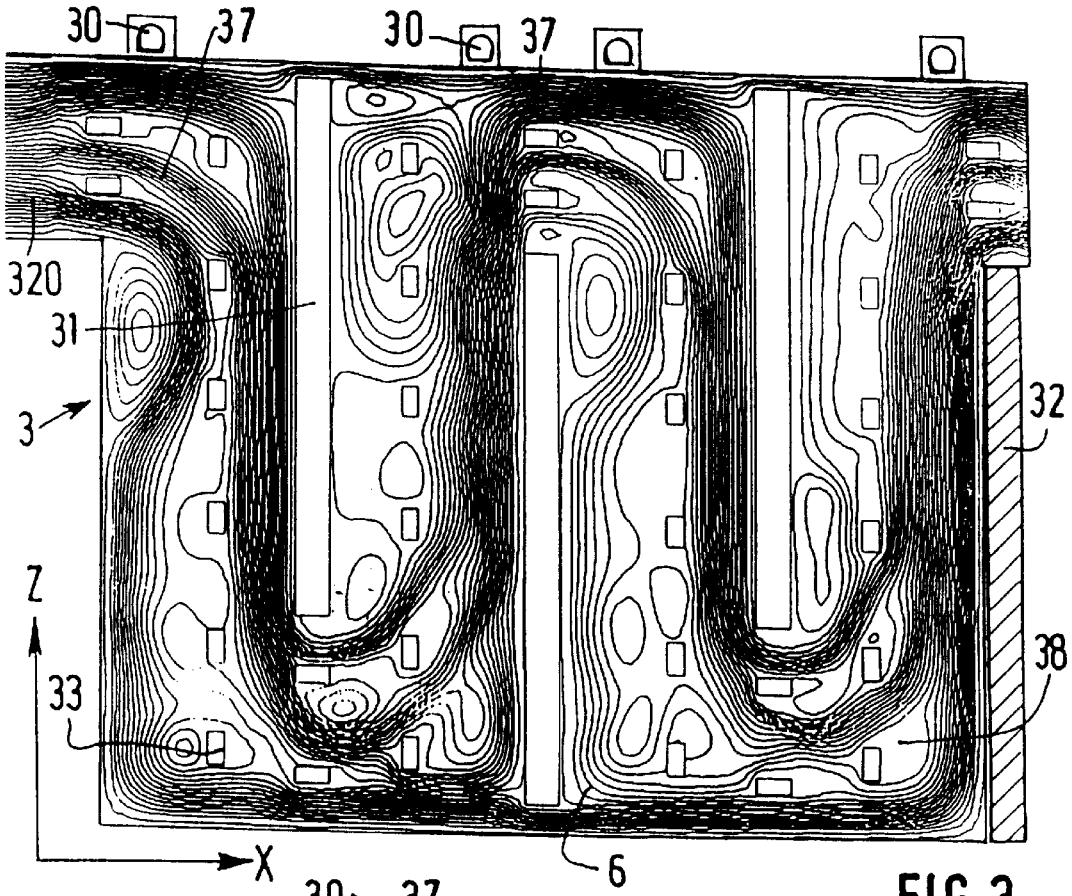
FIG. 3 PRIOR ART
Figure 3A:
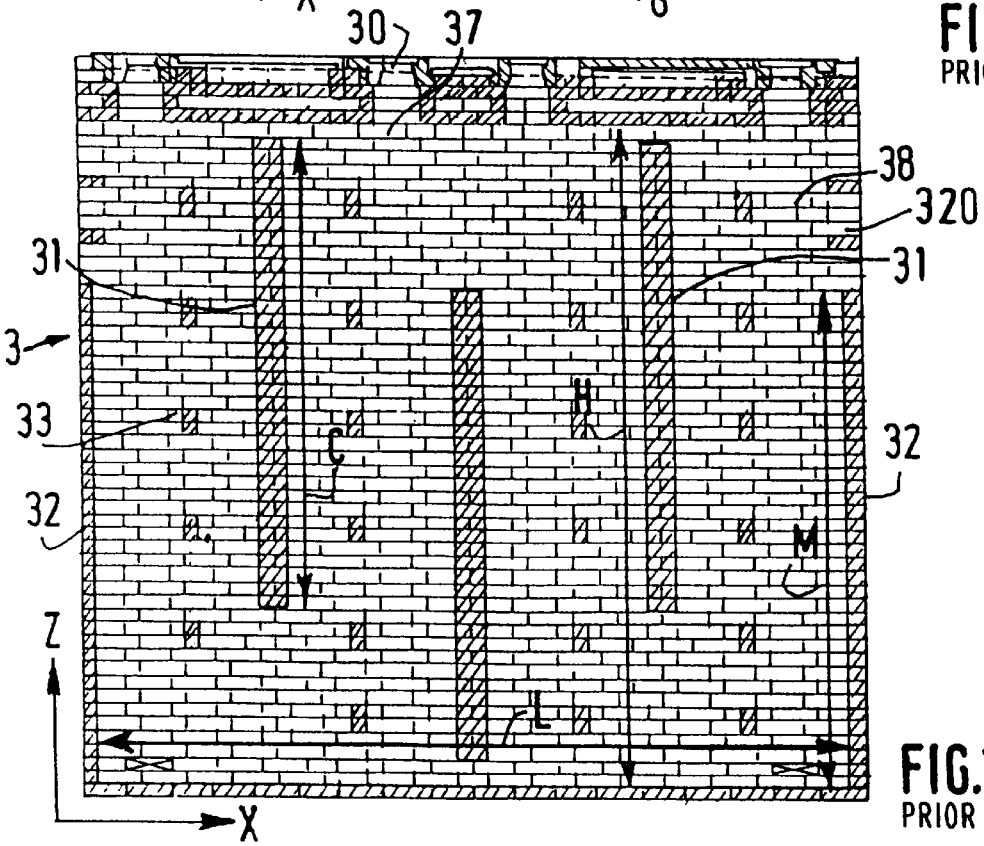
FIG. 3a PRIOR ART

FIG. 3 shows a map of the gas flow obtained by digital simulation broken down into fifty elementary streams 6 in a hollow wall according to the state of the art shown in FIG. 3*a*, provided with 3 baffles 31 and a number of tie bricks 33 maintaining constant spacing between the partitions 38 of the said wall. The length L and the height H of a hollow wail for a given section, the height C of a baffle, the height M of the wall 32 at both ends, are shown in FIG. 3*a*.

Figure 4:
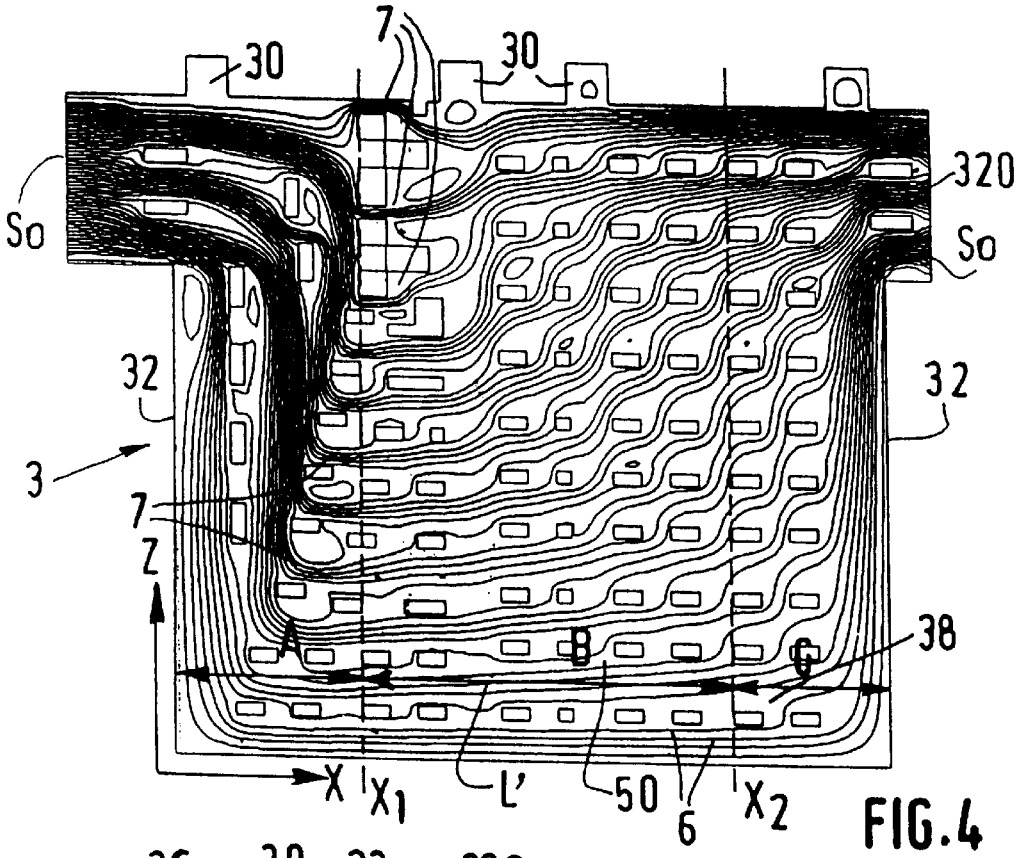
FIGS. 4, 4*a*, 5, 6, 6*a*, 7*a* to 7*d* and 8 are applicable to furnaces according to the invention.
Figure 4A:
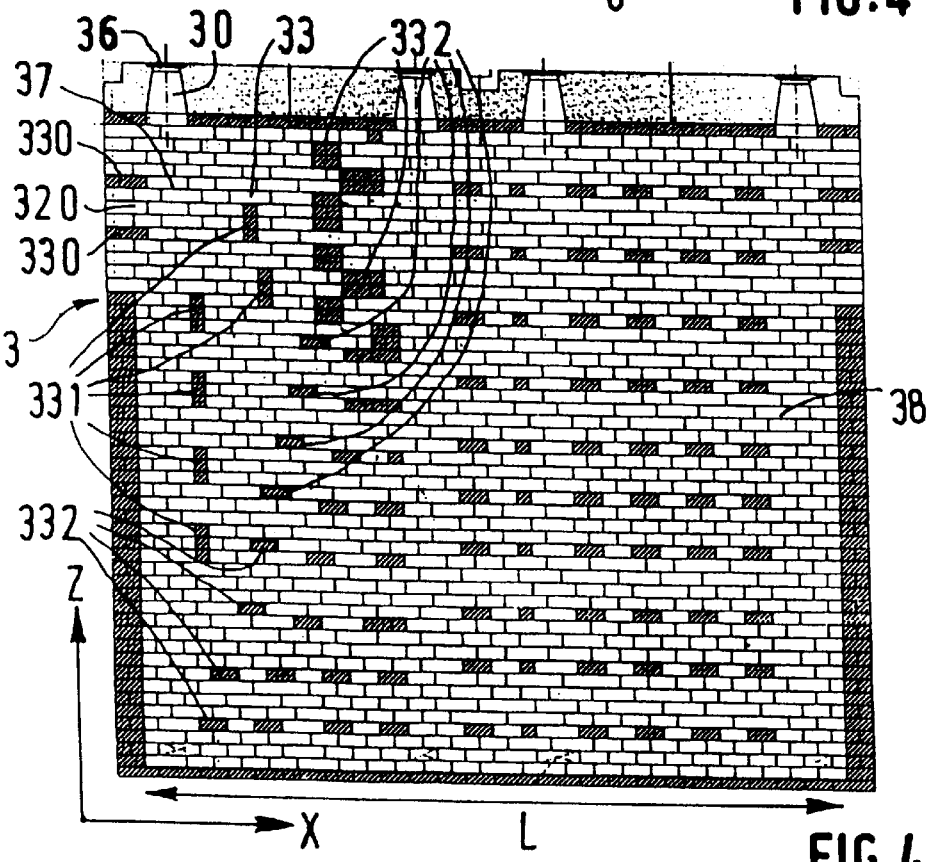

FIGS. 4 and 4*a* are similar to FIGS. 3 and 3*a* but are related to the invention. It is easy to see in FIG. 4 that the degree of homogeneity defined by 0.50D−0.125D/0.25S is achieved over the length L'between abscissas $X_1$ and $X_2$. The following can be seen in FIG. 4, in which the gas flow circulates from the left to the right:

- a first part denoted A, with length less than L/2 and preferably less than L/3, comprising means (particularly tie bricks) of transforming an initial flow with the cross-section So into a flow with a cross-section S extending over the entire hollow cross-section and with the said degree of homogeneity, due to the formation of about ten flow fractions 7;
- a second portion denoted B, with length equal to at least L/3 and preferably at least L/2, in which the said degree of homogeneity is achieved everywhere;
- a third portion denoted C, with the shortest possible length in which the gas flow is concentrated again, the said degree of homogeneity not being achieved since there may be local flow concentrations outside the range 0.50D and 0.125D for a fraction of the cross-section equal to 0.25S.

Figure 5:
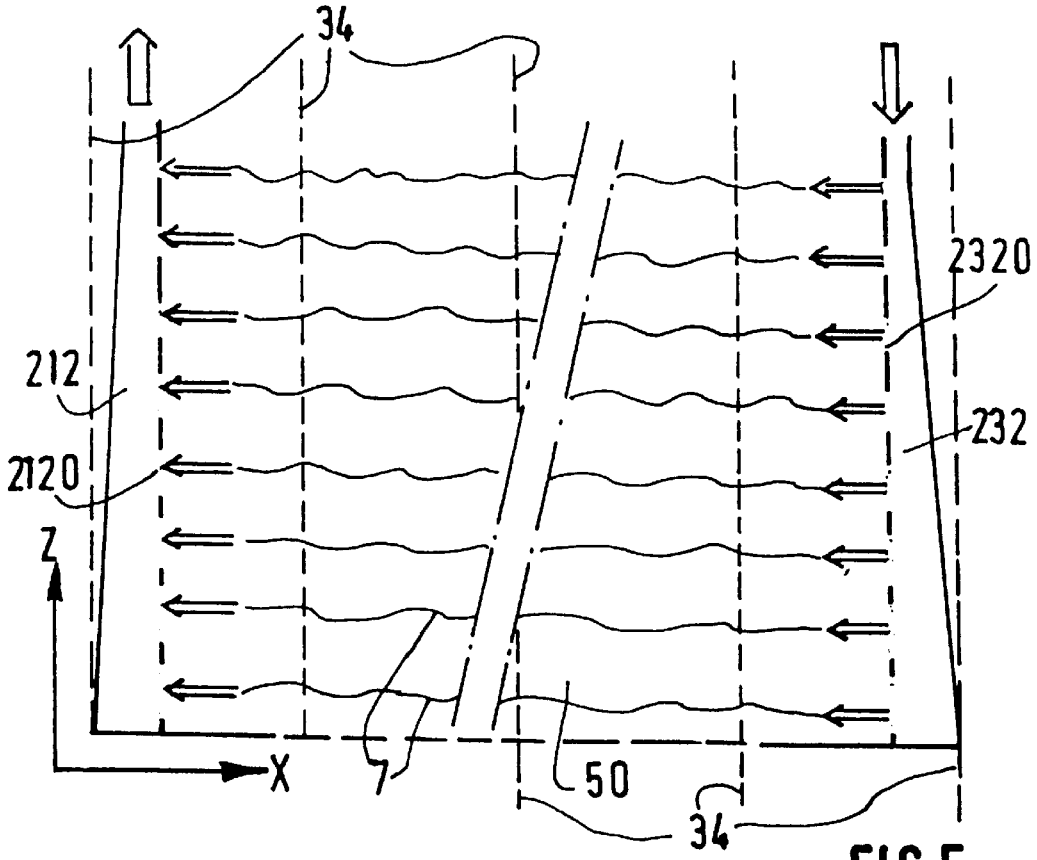

FIG. 5 shows a second embodiment of the invention in a partial diagrammatic sectional view in the X-Z plane shovving the gas flow on the same series of hollow walls of sections simultaneously active for the same rotating fire, in the case in which the sections are not separated by headwall. The gas flow keeps approximately the same cross-section S over its entire path, a distribution means 232 being used on the upstream side of the said rotating fire in order to inject a gas flow through transverse slits or openings 2320 in the form of about ten flow fractions 7 with the said degree of homogeneity, another distribution means 212 being used on the downstream side of the said rotating fire in order to suck up the said gas flow through transverse slits or openings 2120 without affecting the said degree of homogeneity. Only the gas flows in the hollow walls at the two ends have been shown. The gas flow is composed of a set of flow fractions 7 forming a tubular flow 50 located approximately along the longitudinal axis X'-X.

Figure 6:
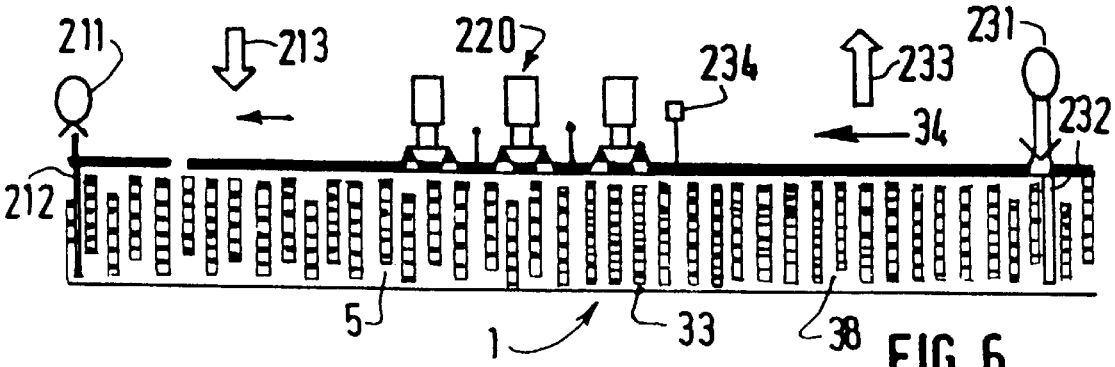
Figure 6A:
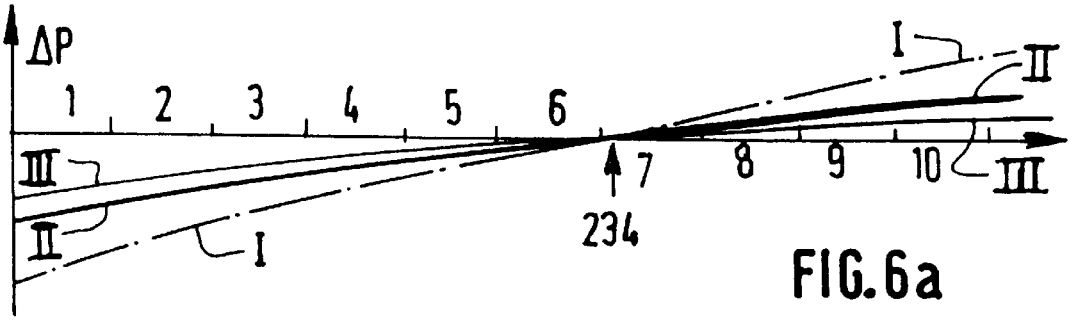
Figures 7A, 7B, 7C, 7D:
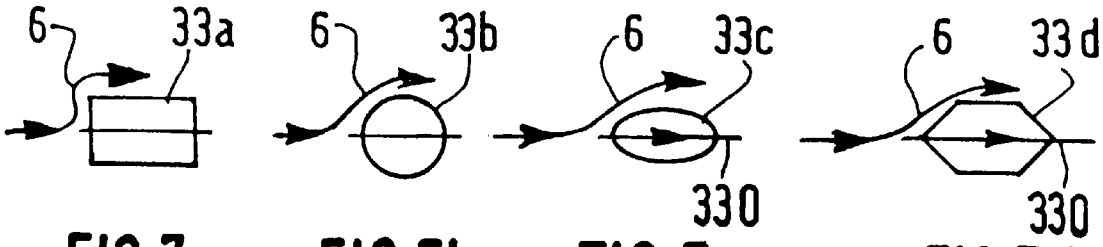

FIG. 6 corresponds to FIG. 1 after modification according to FIG. 5, particularly to eliminate the headwalls 32 and after inserting distribution means 212, 232. This figure does not show means of providing Homogenous heating of the said gas flow at the burners 220. FIG. 6*a* corresponds to FIG. 1*a,* and shows the static pressure curve for the said gas flow in a furnace according to the state of the art (curve I), and in a furnace according to the invention (curves II and III), curve II corresponding to the case in which the sections are separated by headwalls 32 with an orifice 320 through which the gas flow passes, whereas curve III corresponds to the case shown in FIGS. 5 and 6 in which the gas flow maintains approximately the same cross-section S from upstream to downstream.

FIGS. 7*a* to 7*d* are sections in the X-Z plane illustrating tie bricks or elements that deflect the said gas flow, or gas streams 6 that flow around the said tie bricks 33*a*, 33*b*, 33*c*, 33*d*, some 33*c* and 33*d* having an oblong shape with a major axis 330 to facilitate the gas flow and to reduce its pressure loss (loss of read).

Figure 8:
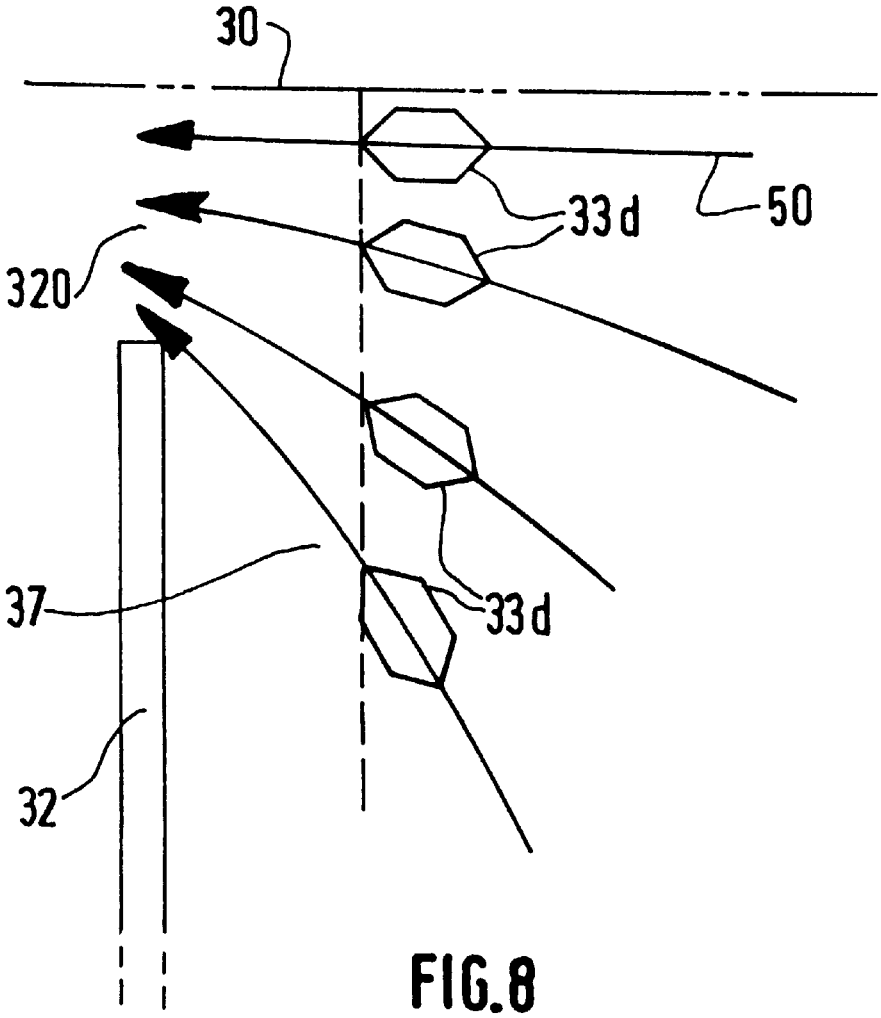

FIG. 8 illustrates the case in which oblong shaped elements 33*c*, 33*d* are used and oriented such that the orientation of the major axis 330 of the said tie bricks coincides with the direction of the gas flow in order to further reduce the pressure loss, particularly in the case in which the said sections are separated by walls 32 in which orifices or openings 320 are formed through which the said gas flow can pass from one section to the next.

DETAILED DESCRIPTION OF THE INVENTION

According to a first embodiment of the invention illustrated particularly in FIGS. 4 and 4*a* the said furnace 1 comprises sections separated by a headwall 32 with openings with cross-section So 320 through which the said gas flow 34, 35 passes from one wall to the next, and in which the said wall comprises a means in its upstream part to create a flow with a cross-section S>So, starting from an initial flow of rate D at cross-section So, with the said degree of homogeneity equal to at least 0.50D−0.125D/0.25S. In this embodiment, the cross-section of the said conduit 5 is not constant, its cross-section being equal to So at each headwall 32 and S>>So in each hollow wall.

Over a distance less than L/2, where L is the length of the said wall, the said means transforms a gas flow D with an initial cross-section So at the entry upstream from the said wall, into a flow with a cross-section S equal to at least 3;So, and with the said degree of homogeneity. Preferably, the said distance is less than L/3. In FIG. 4, the said means is located on the part denoted "A".

Each wall may comprise one or several peepholes 30 in its upper part which may be closed by a cover 36 that provide(s) access to shafts 37.

According to the invention, the said means of achieving the said gas flow of rate D and cross-section S with the said degree of homogeneity consists of divider elements, or tie bricks 33, dividing the said initial flow with cross-section So into about ten flow fractions 7, in a number of steps varying from 2 to 4 as shown in FIGS. 4 and 4*a*. FIG. 4*a* shows three steps as an example, chat could be used co divide the initial flow So: the first comprising 2 tie bricks or elements 330, the second comprising 6 tie bricks or elements 331, and the third comprising 10 tie bricks or elements 332, these 10 tie bricks or elements forming a front, the said degree of homogeneity being achieved on the downstream side of this front (at the right in FIG. 4*a*). The initial flow So is thus divided into 11 flow fractions 7 over the entire cross-section S.

According to another embodiment of the invention as shown in FIGS. 5 and 6, the cross-section of the said conduit 5 is constant, the said walls 32 having openings 320 with approximately the said cross-section S in the Y-Z plane, in order to form conduits 5 with an approximately constant cross-section S from the upstream to the downstream sides, over all hollow walls 3 simultaneously active for the said fire, in which the said degree of homogeneity is achieved by means of a removable distribution means 232 inserted on the upstream side of the said rotating fire, at the upstream end of the said conduit 5 in order to inject the said gas flow with the said degree of homogeneity into each conduit 5, in the form of about ten flow fractions 7—8 fractions are shown in FIG. 5.

Furthermore, in order to maintain the said degree of homogeneity over the longest possible length of the conduit 5, it may be advantageous to use a removable distribution means 212 also on the downstream side of the said rotating fire, at the downstream end of the said conduit 5 formed by the series of hollow walls 3 active for the said fire, in order to induce the said gas flow without disturbing the said degree of homogeneity of the said gas flow on the upstream side.

According to the invention, the said distribution means 212, 232 may be a containment or a parallelepiped shaped distribution panel 232 with a plane horizontal cross-section in the X-Y plane, chosen such that the said containment may be inserted vertically into the said shaft 37 in the said wall 3 or between two sections, or it may have a plane cross-section in the Y-Z plane slightly smaller than the said cross-section S of the said wall in the Y-Z plane, with a face parallel to the Y-Z plane provided with openings 2320 with a geometry calculated either to inject the said gas flow in the form of flow fractions 7 with the said degree of homogeneity on the upstream side of the said conduit 5, or to suck up the said gas flow on the downstream side of the said conduit 5.

Regardless of the embodiment of the invention, the said means of maintaining a gas flow of rate D with the said degree of homogeneity over the said cross-section S comprises a plurality of elements or tie bricks 33 fixed to the said lateral partitions 38 and distributed approximately uniformly along the surface of the said lateral partitions 38 in the X-Z plane of the said wall or the said conduit, depending on the results of the digital simulation, with a sufficient number to ensure the said constant spacing between the said lateral partitions 38, so as to divide the said gas flow into a number of flow fractions 7 varying from 3 to 20 and uniformly distributed over the said entire cross-section S, and for the said fractions to produce a flow with a predetermined orientation, possibly along the said longitudinal direction X of the furnace, in order to give an approximately tubular flow 50 over all or part of the conduit 5 depending on the embodiment of the invention.

According to the first embodiment of the invention illustrated in FIG. 4, about ten flow fractions 7 are observed over the entire cross-section S in the part denoted "B" with length L' over which the said degree of homogeneity is achieved, each flow fraction 7 possibly containing several elementary streams 6 represented as continuous lines in FIG. 4.

The second embodiment is diagrammatically illustrated in FIG. 5, and also has about ten flow fractions 7, although the tie bricks are not shown in this figure.

It may be advantageous for the said elements or tie bricks 33 to be profiled so as to reduce the pressure loss of the said gas flow, while performing all other functions necessary to maintain a constant spacing between the said side walls 38, and to achieve or maintain the said predetermined degree of homogeneity over the said cross-section S, for the said gas flow.

FIGS. 7*a* to 7*d* are sectional views in the X-Z crane illustrating different profiles of tie beams or elements 33*a*, 33*b*, 33*c*, 33*d*, some (33*c* and 33*d*) being oblong shaped with a major axis 330 to facilitate penetration of gas flow and reduce pressure losses (head losses). The pressure loss P will normally be such that $P_{33a}>P_{33b}>P_{33c}$ and $P_{33d}$.

It may also be advantageous to use oblong shaped elements 33*c*, 33*d* in order to further reduce the pressure loss, and to orient them as shown in FIG. 8 such that the orientation of the major axis 330 of the said tie tricks is parallel to the direction of the gas flow, particularly in the case in which the said sections are separated by walls 32 provided with orifices or openings 320 through which the said gas flow can pass from one section to the next.

EXAMPLE EMBODIMENT

A furnace 1 of the type shown in FIG. 1 was modeled and then built, comprising hollow walls as shown in FIGS. 4 and 4*a* according to the invention, built with refractory bricks and tie bricks. FIG. 4*a* is the construction drawing for the hollow wall 3, like any brick wall, the cross-hatched elements extending transversely (Y-Y' direction) over the entire width (0.5 m) of the said wall—this width including a 0.3 m gas stream and 2×0.1 m hollow wall thicknesses. The scale in. FIGS. 4 and 4*a* is given by L=4.178 m, and by the thickness of each refractory brick=91.5 mm.

Before building this furnace, the gas flow streams inside the hollow walls were modeled by dividing the total flocks into about the fifty elementary flows or gas streams 6, the representation of a configuration according to the invention obtained by the said modeling was used to produce FIG. 4 which shows the path of each gas stream 6. The said modeling was made using computer means known in themselves.

FIG. 4 shows 3 zones denoted A, B and C, the gas flow circulating from left to right:

- zone A corresponds to the formation of a gas flow with a cross-section S presenting the said degree of homogeneity starting from a gas flow with cross-section So<<S,
- zone B corresponds to an approximately tubular flow of the said gas flow, which has the said degree of homogeneity (with y=0.25 over a length L' of the wall,
- zone C is; the part in which the gas flow concentrates again, reducing from a cross-section S to a cross-section So, at the passage through the wall between two successive sections.

ADVANTAGES OF THE INVENTION

The furnace according to the invention can actually solve the problem caused (either to maintain a constant quality of the carbonaceous blocks, or the energy consumption of the furnace, or the life of the furnace, in all these respects); this invention is an improvement over existing furnaces made according to the state of the art.

The energy consumption of the furnace is significantly reduced partly due to a better temperature homogeneity which prevents unnecessary local overheating, and due to a lower pressure loss (see FIG. 6*a*).

The global gain, both in the energy consumption of the furnace and the consumption of refractory bricks, is at least 10%, which is considerable in this type of industry.

What is claimed is:

1. Ring furnace (1) with open type sections (2) for baking carbonaceous blocks (40) in a rotating fire comprising, along the longitudinal X direction of the furnace, a series of sections (2) separated by headwall, (32) provided with openings (320), each section comprising, along the transverse Y direction of the furnace, hollow walls (3) through which a heating gas flow (35) comprising combustion gas or a cooling air flow (34) circulates, alternating with pits (4) containing carbonaceous blocks (40) to be baked, each of the said hollow walls (3) in a section (2) being in communication with a wall in an upstream section and/or a wall in a downstream section, so as to form a conduit (5) through which the said gas flow (34, 35) circulates from the upstream side to the downstream side, in the X longitudinal direction on all sections burned simultaneously in the said rotating fire, each of the said wall, of a section comprising two vertical lateral partitions (38) in the X-Z plane, and elements in the transverse Y direction for deflecting the said gas flow passing through the said wall and maintaining a constant spacing between the said lateral partitions (38), characterized in that each wall (3) comprises a means of maintaining, over at least one third of the length L of said wall, a gas flow of rate D uniformly distributed over the entire normal cross-section S of the said wall in the Y-Z plane, with a degree of uniformity of the said flow distribution D defined by the expression "2yD−0.5yD/yS", where "2yD−0.5yD" denotes the extent of the range of the flow of rate D corresponding to a fraction y of the said normal cross-section S, and in which y is not more than 0.25.

2. Furnace according to claim 1, comprising sections separated by a headwall (32) with openings with cross-section So (320) through which the said gas flow (34, 35) passes from one wall to the next wall, and in which the said wall comprises a means in its upstream part for obtaining a flow with cross-section S>So, starting from an initial flow of rate D with cross-section So, with a degree of homogeneity equal to at least 0.50D−0.125D/0.25S.

3. Furnace according to claim 2, in which the said means transforms a gas flow of rate D with an initial cross-section So at the upstream entry to the said wall, into a flow with a cross-section S equal to at least 3;So and with the said degree of homogeneity, over a distance smaller than half the length X of the said wall.

4. Furnace according to claim 2, in which the said means of obtaining the said gas flow of rate D with cross-section S and the said degree of homogeneity is composed of dividing elements or tie beams, dividing the said initial flow with cross-section So through a number of steps varying from 2 to 4.

5. Furnace according to claim 4, in which the said elements or tie beams (33) are profiled so as to reduce the pressure loss in the said gas flow, while providing other required functions in order to maintain a constant separation between the said side walls (38) and to achieve or maintain the said predetermined degree of homogeneity over the entire cross-section S, for the entire gas flow.

6. Furnace according to claim 1 in which the said conduit has a constant cross-section, the said walls (32) having openings (320) with approximately the said cross-section S in the Y-Z plane, in order to form conduits (5) with an approximately constant cross-section S by a series of hollow walls (3) active simultaneously for the said fire, in which the said degree of homogeneity is achieved by a removable distribution means inserted on the upstream side of the said rotating fire at the upstream end of the said conduit (5) in order to reinject the said gas flow into each conduit (5) with the said degree of homogeneity.

7. Furnace according to claim 6, in which the said degree of homogeneity is also achieved using the said removable distribution means inserted on the downstream side of the said rotating fire, at the downstream end of the said conduit (5) formed by the series of hollow walls (3) active for the said fire, in order to suck up the said gas flow without disturbing the said degree of homogeneity of the said gas flow on the upstream side.

8. Furnace according to claim 6, in which the said distribution means is a containment or a parallelepiped shaped distribution panel (232) with a plane horizontal section in the X-Y plane, chosen such that the said containment can be inserted vertically in the said shaft (37) of the said wall (3) or between two sections, and the said vertical plane cross-section in the Y-Z plane is slightly smaller than the said cross-section S of the said wall in the Y-Z plane, with a surface parallel to the Y-Z plane provided with openings (2320) with a geometry calculated either to inject the said gas flow with the said degree of homogeneity on the upstream side of the said conduit (5), or to suck up the said gas flows on the downstream side of the said conduit (5).

9. Furnace according to claim 1, in which The said means of maintaining a gas flow of rate D with the said degree of homogeneity over the said cross-section S comprises a number of elements or tie beams (33) fixed to the said lateral partitions (38) and uniformly distributed over the surface of the said lateral partitions (38) in the X-Z plane of the said wall or the said conduit, with a sufficient number to ensure the said constant separation between the said lateral partitions (38) in order to divide the said gas flows into a number of flow fractions varying from 3 to 20, uniformly distributed over the entire cross-section S, and to ensure a flow with a predetermined orientation for the said fractions, and possibly along the said longitudinal direction X of the furnace.

* * * * *

UNITED STATES PATENT AND TRADEMARK OFFICE

CERTIFICATE OF CORRECTION

PATENT NO. : 6,027,339

DATED : February 22, 2000

INVENTOR(S) : CHRISTIAN DREYER et al

It is certified that error appears in the above-indentified patent and that said Letters Patent is hereby corrected as shown below:

Column 5, line 20, change "—we" to --two--;

line 31, change ":o" to --to--.

Column 6, line 61, change "3;So" to --3·So--.

Claim 1, line 16 (column 9, line 28), change "wall," to --walls--.

Claim 3, line 4 (column 9, line 53), change "3;So" to --3·So--.

UNITED STATES PATENT AND TRADEMARK OFFICE

CERTIFICATE OF CORRECTION

PATENT NO. : 6,027,339

DATED : February 22, 2000

INVENTOR(S) : CHRISTIAN DREYER et al

It is certified that error appears in the above-identified patent and that said Letters Patent is hereby corrected as shown below:

Claim 9, line 1 (column 10, line 44), change "The" to --the--.

Signed and Sealed this

Sixteenth Day of January, 2001

*Attest:*

*Attesting Officer*

Q. TODD DICKINSON

*Commissioner of Patents and Trademarks*